US005260159A

United States Patent [19]

Ohtani et al.

[11] Patent Number: 5,260,159

[45] Date of Patent: Nov. 9, 1993

[54] DEVELOPER FOR FULL COLOR COPY CONTAINING LIGHT-TRANSMITTABLE TONER AND RESIN-COATED CARRIER HAVING PORES

[75] Inventors: Junji Ohtani, Kobe; Junji Machida, Toyonaka; Yoshihisa Terasaka, Settsu, all of Japan

[73] Assignee: Minolta Camera Kabushiki Kaisha, Osaka, Japan

[21] Appl. No.: 727,984

[22] Filed: Jul. 10, 1991

[30] Foreign Application Priority Data

Jul. 12, 1990 [JP] Japan ..... 2-186693

[51] Int. Cl.[5] ..... G03G 9/107; G03G 9/113

[52] U.S. Cl. ..... 430/106.6; 430/108; 430/109; 430/110; 430/111

[58] Field of Search ..... 430/108, 109, 110, 111, 430/106.6

[56] References Cited

U.S. PATENT DOCUMENTS

| | | | |
|---|---|---|---|
| 3,998,747 | 9/1974 | Yamakami et al. | 430/106 |
| 4,564,647 | 7/1981 | Ohtani et al. | 523/211 |
| 4,845,003 | 7/1989 | Kiriu et al. | 430/110 |
| 5,093,201 | 3/1992 | Ohtani et al. | 430/108 X |

FOREIGN PATENT DOCUMENTS

| | | | |
|---|---|---|---|
| 19059 | 2/1981 | Japan | 430/108 |
| 57-86837 | 5/1982 | Japan . | |
| 2-69771 | 3/1990 | Japan . | |
| 146061 | 6/1990 | Japan | 430/108 |
| 187770 | 7/1990 | Japan | 430/108 |
| 187771 | 7/1990 | Japan | 430/108 |

*Primary Examiner*—Roland Martin

*Attorney, Agent, or Firm*—Burns, Doane, Swecker & Mathis

[57] ABSTRACT

This invention relates to a two-component developer for full color copy in the combination of small toner particles which are light-transmittable and composed of a specified resin with carrier particles having pores and/or irregularities.

22 Claims, 4 Drawing Sheets

DEVELOPER FOR FULL COLOR COPY CONTAINING LIGHT-TRANSMITTABLE TONER AND RESIN-COATED CARRIER HAVING PORES

BACKGROUND OF THE INVENTION

This invention relates to a developer for full color copy. In more particular, this invention relates to a developer for full color copy in which original color images are duplicated in the combination of three color toners by means of a three color resolution exposure process or a three primary color subtractive process (which may include black toner).

Electrophotographic technique is widely applied, for example, to PPC, printer and the like. Recently, full color copied images have been able to be formed by piling different color toners (for example, Japanese Patent Laid-Open Sho 50-62442). As such a developer for full color copy is used mainly in order to duplicate pictures, photographs, graphics and the like, the copied images are generally solid. Therefore, the developer contains toner particles at a content of 6–12%, higher than a usual mixing ratio in a developer for only black. As a toner content increases, the contact possibility between toner and carrier becomes smaller and toner is supplied more often. Accordingly, because non-charged toner is often supplied, the delay of electrification-buildup of toner and the lack of toner charge amount are brought about, resulting in problems such as toner scattering, fogs and the like.

On the other hand, a resin component of toner contained in a developer for full color copy is the one having low viscosity from the view points such as transparency, adhesivity between plural color layers laminated on a copying paper and so there arises a problem of toner aggregations.

In addition, as a full color toner contains a different colorant depending on respective colors, each color toner has different charging properties. Accordingly, a carrier which can charge a color toner most suitably should be designed and researched depending on the properties of respective color toners. Even though color is same, a carrier should be also designed and researched when different kinds of colorants are contained.

SUMMARY OF THE INVENTION

The object of the present invention is to provide a developer for full color copy excellent in electrification-build-up properties of toner and without problems such as toner scattering, fogs and the like.

Another object of the present invention is to provide a developer for full color copy in which toner particles do not aggregate.

Another object of the present invention is to provide a developer for full color copy in which a carrier can be used in the combination with every color toners.

The present invention relates to developer containing at least;

light transmittable toner particles comprising a styrene-acrylic resin as a main component having a number average molecular weight (Mn):

$$3000<Mn<15000$$

a weight average molecular weight (Mw):

$$2<Mw/Mn<6$$

and a melting point (Tm);

$$60^\circ C.<Tm<120^\circ C.,$$

or a light-transmittable toner particles comprising a polyester resin as a main component having a number average molecular weight (Mn):

$$2500<Mn<10000$$

a weight average molecular weight (Mw):

$$2<Mw/Mn<6$$

a melting point (Tm);

$$80^\circ C.<Tm<120^\circ C.,$$

and carrier particles with a number of pores having a mean pore size of 0.1–0.5 μm on the surface thereof, the carrier particles comprising core materials having magnetism and resin materials coating the core materials.

DETAILED DESCRIPTION OF THE INVENTION

The present invention provides a developer for full color copy excellent in electrification-buildup properties of toner, prevention of toner scattering, disintegrating properties of toner aggregations.

The present invention has accomplished the above objects by combining light-transmittable full color toner formed of a specified resin with a resin-coated carrier having pores on the surface thereof.

The present invention provides a developer of full color copy containing at least;

light transmittable toner particles comprising a styrene-acrylic resin as a main component having a number average molecular weight (Mn):

$$3000<Mn<15000$$

a weight average molecular weight (Mw):

$$2<Mw/Mn<6$$

and a melting point (Tm);

$$60^\circ C.<Tm<120^\circ C.,$$

or a light-transmittable toner particles comprising a polyester resin as a main component having a number average molecular weight (Mn):

$2500 < Mn < 10000$ a weight average molecular weight (Mw):

$2 < Mw/Mn < 6$ a melting point (Tm);

$80° C. < Tm < 120° C.$, and carrier particles with a number of pores having a mean pore size of 0.1–0.5 μm on the surface thereof, the carrier particles comprising core materials having magnetism and resin materials coating the core materials.

A developer of the present invention comprises at least a resin-coated carrier and a light-transmittable toner.

First, the resin-coated carrier is explained hereinafter.

Figure 1:
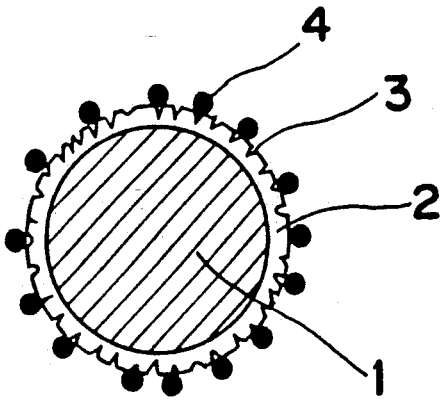
FIG. 1 shows a schematic sectional view of a resin-coated carrier having pores.
Figure 3:
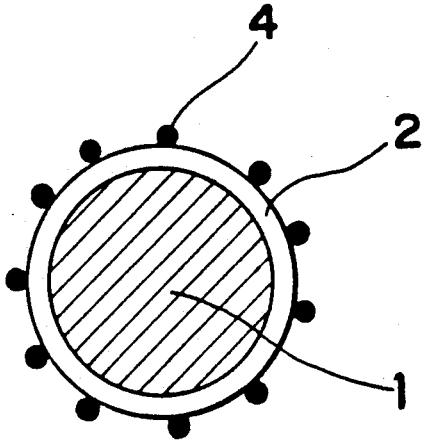
FIG. 3 shows a schematic sectional view of a resin-coated carrier having no pores.

A schematic sectional view of the resin-coated carrier having the pores is shown in FIG. 1 for easy understanding. A schematic sectional view of a resin-coated carrier having not pores is also shown in FIG. 3.

In FIG. 1, the number (1) shows a carrier core material, the number (2) shows a resin-coating layer and the number (3) shows pores formed on the resin-coating layer. The carrier shown in FIG. 3 has not the pores (3). The pores on the surface of carriers function to contact toner particles (4) with the carrier particles sufficiently and effect speedy electrification-buildup and uniform charging of toner even though the toner is light-transmittable. Toner scattering caused by poor charging can be prevented. It also effects the prevention of toner scattering that the pores on the carrier surface are excellent in trapping toner particles.

Further, the pores effect the prevention of toner particles from aggregation and the disintegrating of aggregated toner particles because the toner particles contact with the carrier particles frequently. Therefore, the problem of toner aggregation, which is brought about particularly by toner particles having low viscosity, can be solved.

The pores on the surface of the resin-coated layer can be specified concretely by pore size distribution, mean pore size and total pore volume.

The desirable pore size distribution is within the range of 0.001–3 μm, preferably 0.001–2 μm, more preferably 0.005–2 μm. If the pore size is smaller than 0.001 μm, satisfactory effects can not be expected in the view point of toner-disintegrating properties. If the pore size is larger than 3 μm, the toner-trapping properties become much strong, resulting in the deterioration of toner fluidity and developing properties.

The desirable mean pore size is within the range of 0.1–0.5 μm.

Thereby, the disintegrating properties of toner aggregation and the charging properties of toner can be improved.

The total pore volume can be expressed in two ways. The one has the unit (mg/g) referred to as one gram of carrier and the other has the unit (ml/ml) referred to as one milliliter of resin of coating layer.

The total pore volume (ml/g) referred to as one gram of carrier can be determined by mercury porosimetry. The desirable total pore volume (ml/g) is within the range of 0.001–0.1 ml/g, preferably 0.01–0.05 ml/g. If the volume is smaller than 0.001 (ml/g), the sufficient number of pores do not exist on the carrier surface, so that the effects caused by the pores may not be obtained. If the volume is larger than 0.1 ml/g, there exist so many pores that the coating layer becomes fragile.

The total pore volume (ml/ml) can be calculated from a specific gravity of coating layer and a filling ratio of carrier core material on the basis of the total pore volume (ml/g). The desirable total volume (ml/ml) is within 0.1–2 ml/ml, preferably 0.5–1.5 ml/ml. If the volume is smaller than 0.1 ml/ml, the sufficient number of pores do not exist on the carrier surface, so that the effects caused by the pores may not be obtained. If the volume is larger than 2 ml/g, there exist so many pores that the coating layer becomes fragile.

Then, the components of the carrier of the present invention are explained hereinafter.

With respect to the carrier core material, which is one of elements of the carrier of the present invention, the one having a mean particle size of at least 20 μm in view of the prevention of adherence (scattering) of carrier particles to a supporter of an electrostatic latent image and at most 100 μm in view of the prevention of deterioration of image quality, for example the prevention of generation of carrier lines, is used. Concretely speaking, materials known as electrophotographic carriers for a two-component developer, for example, metals such as ferrite, magnetite, iron, nickel, cobalt, alloy thereof, a mixture thereof, alloys or mixtures of the above metals with metals such as zinc, antimony, aluminum, lead, tin, bismuth, beryllium, manganese, selenium, tungsten, zirconium, vanadium and the like, metal oxides such as iron oxides, titanium oxides, magnesium oxides and the like, nitrides such as chrome nitrides, vanadium nitrides and the like, and carbides such as silicon carbides, tungsten carbides and the like, ferromagnetic ferrites, and mixtures thereof, can be used.

The resins which are suitable to coat the carrier core materials may be exemplified by thermoplastic resins such as polystyrenes, poly(metha)acrylic resins, polyolefinic resins, polyamide resins, polycarbonate resins, polyether resins, poly(sulfine acid) resins, polyester resins, epoxy resins, polybutyral resins, urea resins, urethane/urea resins, silicon resins, polyethylene resins, teflon resins and the like, thermosetting resins, a mixture thereof, copolymers thereof, block copolymers thereof, graft copolymers thereof, a blender thereof and the like. Resins having polar group may be used in order to improve chargeability.

In particular, a light-transmittable toner used in the combination with the carrier is composed of a resin having relatively low viscosity because light-transmittance is required. From this viewpoint, a preferable resin which coats carrier materials is the one excellent in release properties such as silicon resins, polyolefinic resins and the like.

The core material of carrier is coated by a resin so that 70% or more, preferably 90% or more, still more preferably 95% or more of surface area of the cores may be coated. If the coating ratio is lower than 70%, characteristics of the carrier core material itself (unstable environmental resistance, reduction of electric resistance and unstable charging properties) strongly appear, so that the advantages of the coating with resins can not be obtained.

A content of carrier core material based on the carrier (hereinafter referred to as "filling ratio" (wt. %)) is set at about 90 percents by weight or more, preferably 95 percents by weight or more. The filling ratio may be understood to show indirectly a layer-thickness of carrier coated with resin. If the filling ratio is lower than 90 percents by weight, the coating layer becomes so thick that, for example, the coating layer is separated, the charge amount being increased, the durability and the charging stability being not satisfactory. In view of the image quality, the fine line reproducibility is inferior and the image concentration is reduced, when the carriers are used as a developer.

The layer-thickness of coating resins may be indirectly expressed also by a true specific gravity. The true specific gravity of the carriers according to the present invention is greatly changed by a kind of carrier core material, but it is set at about 3.5 to 7.5, preferably about 4.0 to 6.0, still more preferably about 4.0 to 5.5, so far as the carrier core material is used. If the specific gravity of the carriers is outside of the range, problems similar to those incidental to the carriers, which are not coated at the suitable content, occur.

An electric resistance of the resin-coated carriers with irregularities according to the present invention is set at about $1\times10^6$ to $1\times10^{14}$ ohm.cm, preferably about $10^8$ to $10^{13}$ ohm.cm, still more preferably about $10^9$ to $10^{12}$ ohm.cm. If the electric resistance is lower than $1\times10^6$ ohm.cm, the carriers are developed to deteriorate the image quality. In addition, if the electric resistance exceeds $1\times10^{14}$ ohm.cm, toners are electrically charged excessively, so that the appropriate image concentration can not be obtained. It can be also thought that the electric resistance indirectly expresses the coating ratio with resins and the filling ratio of carrier core materials.

Figure 2:
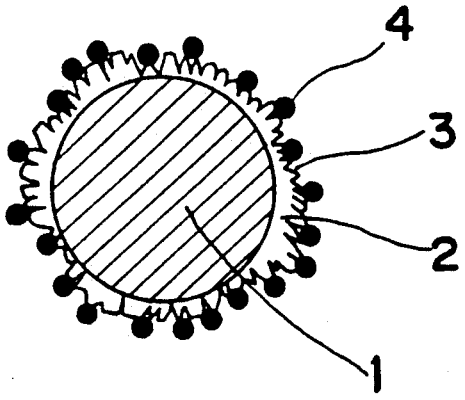
FIG. 2 shows a schematic sectional view of a carrier having pores on an irregular resin-coating layer.

In further preferable embodiment, the carrier used in the present invention is provided with irregularities. FIG. 2 shows such a carrier, in which pores (3) exist on the surface of irregular resin-coating layer (2). The irregular resin-coating layer improves electrification-buildup properties of toner, prevention of toner scattering, disintegrating properties of toner aggregation and the like.

The surface irregularity is explained in detail hereinafter.

The irregularity of the surface may be represented by the shape factor S represented by the following formula [I]:

$$S=\{(\text{outside circumference})^2/\text{area})\}\times\{1/(4\pi)\}\times100 \quad [I]$$

wherein the "outside circumference" is a mean value of outside circumferences of projected images of the carrier particles and the "area" is a mean value of projected areas of the carrier particles. Its preferable value S is 130 to 200. The value S represents a degree of irregularity of the surface of particles. The greater the degree of irregularity of the surface is, the further than 100 it shows.

The shape factor S can be measured, for example, by an image analyzer (Louzex 5,000 manufactured by Japan Regulator K.K.) but it has been observed that in general the measurement of the shape factor is independent upon a kind of image analyzers, so that the image analyzer used for the measurement of the shape factor S is not limited by the above described kind of image analyzer.

Additives, such as fine particles having a charge controlling function or electrically conductive fine particles, may be added to a resin layer in the present invention.

Concretely speaking, the fine particles having a charge controlling function include metal oxides, such as $CrO_2$, $Fe_2O_3$, $Fe_3O_4$, $IrO_2$, $MnO_2$, $MoO_2$, $NbO_2$, $PtO_2$, $TiO_2$, $Ti_2O_3$, $Ti_3O_5$, $WO_2$, $V_2O_3$, $Al_2O_3$, MgO, $SiO_2$, $ZrO_2$ and BeO, dyestuffs such as Nigrosine Base and Spilon Black TRH and the like.

The electrically conductive fine particles include carbon blacks, such as carbon black, acetylene black and the like, carbides, such as SiC, TiC, MoC, ZrC and the like, nitrides, such as BN, NbN, TiN, ZrN and the like, magnetic powders, such as ferrite, magnetite and the like.

The addition of metal oxides, metal fluorides and metal nitrides is effective for the further enhancement of the chargeability. Such a effect seems to be brought about by a synergism of the charging effects of the respective ingredients and the toners resulting from a contact of a complicated boundary surface formed with such the compounds, polyolefin and the core material with the toners.

The addition of carbon black is effective for the enhancement of the development and the obtainment of an image having a high image concentration and a clear contrast. It seems that the addition of the electrically conductive fine particles, such as carbon black, leads to a moderate reduction of electric resistance of the carriers and the well-balanced leak and accumulation of electric charge.

One of characteristics of the conventional binder type carriers consists in the superior reproducibilities of half-tone and tone gradient. With respect to the coated carriers according to the present invention, the carriers superior in reproducibility of tone gradient are obtained by adding magnetic powders to the resin-coating layer. It seems that a surface composition similar to that of the binder type carriers is obtained by adding the magnetic powders to the resin-coating layer, whereby the chargeability and specific gravity approach to those of the binder type carriers.

The addition of borides and metal carbides is effective for electrification-buildup properties.

The size of the above additives, the additional quantity of the additives and the like are not specially limited so far as various kinds of characteristic of the carriers according to the present invention such as carrier form, coating ratio, electric resistance and the like described in the specification of the present invention, are satisfied. But, in relation to a method of producing the carriers according to the present invention, which will be mentioned later, the size of the fine particles may be allowed to such a degree that, for example, they are uniformly dispersed in resin solution or dehydrated hexane to be turned into a slurry without cohering. Concretely speaking, a volume mean particle size may be 2 to 0.001 μm, preferably 1 to 0.01 μm.

Also the quantity of the above additives can not be generally limited. But, 0.1 to 60 percents by weight, preferably 1.0 to 40 percents by weight, based on the resin materials coating the core materials, is suitable.

In particular, when the filling ratio is adjusted to 90–97 percents by weight according to the present invention, it is preferable that the additives, such as the fine particles having a charge controlling function, the electrically conductive particles or the like are added into the resin-coating layer.

In the case where the filling ratio of carriers is small, i.e. about 90 percents by weight or less, namely when a coating layer is comparatively thick, a problem occurs in that the reproducibility is reduced when the continuous copying of fine lines is conducted by the use of such a carrier. Such a problem, however, can be solved by adding the above additives.

Then, a production method of resin-coated carrier with pores are explained. The production method is not particularly limited so far as the carriers having the pores as above mentioned can be obtained. There are two preferable production methods.

One of the preferable methods is as follows. Fine particles which are soluble in an adequate solvent are dispersed in a resin solution in advance, the solution is applied to carrier particles to form a resin-coating layer, the carrier particles are dipped in a solvent which can dissolve the fine particles, and then the fine particles are eluted to form pores on the surface of carrier. In this preparation method, the pore size is dependent on particle size and dispersion degree of the fine particles.

With respect to fine particles, alkali metal halides, alkali earth metal halides, alkali metal hydroxides, alkali earth metal hydroxides, transition metal complexes and the like can be used. With respect to the solvents which can solve the fine particles, it is required not to dissolve the coating-layer.

In a particular embodiment, in the case where the resin-coating layer contains ferrite particles, the ferrite particles can be eluted by dipping in an acidic aqueous solution such as hydrochloric acid etc.. Thereby, the core are formed on the surface of carrier.

When the fine particles having a charge controlling function or the electrically conductive particles are added to the resin-coating layer, these additives are added to a resin solution for preparation of coating-layer at the same time. Ferrite and the like which can be used both for forming pores and for providing electrical conductivity are useful from productive and characteristic viewpoints.

The other preferable production method is a surface coating method by polymerization.

Such a surface coating method by polymerization can be carried out by polymerizing olefinic monomer such as ethylene on a carrier core material which is treated in advance with a highly active catalyst ingredient containing titanium and/or zirconium and soluble to hydrocarbon solvents in the presence of organic aluminum compounds. Fine particles having a charge controlling function and electrically conductive fine particles may be added at the formation of the resin-coating layer. For example, the method disclosed in U.S. Pat. No. 4,564,647 and in Japanese Patent Laid-Open No. Sho 60-106808 and Laid-Open No. Sho 60-106809 are suitable. The publication is herein cited as a part of the specification of the present invention. According to the coating method by polymerization, a coating layer excellent in durability is formed because of layer strength and adhesivity to core material.

When a coating layer is formed by the surface-coating method by polymerization, the pores above mentioned can be formed on the surface of carrier and in addition, the layer strength and the adhesivity of the coating layers to core materials are excellent enough to achieve durability of carriers.

Then, a light-transmittable color toner, one of components of a developer of the present invention, is explained.

A light-transmittable color toner used in the present invention comprises at least a binder resin, a colorant and a charge controlling agent.

Preferable binder resins for the light-transmittable color toner are styrene-acrylic resins or polyester resins.

The styrene-acrylic copolymer resins mean copolymers of styrene or a derivative thereof with (metha) acrylic acids (which include acrylic acid and methacrylic acid) or a derivative thereof. A suitable styrene-acrylic copolymer has a number average molecular weight (Mn) of 3000 -15000, a dispersion degree (a ratio of a weight average molecular weight to a number average molecular weight (Mw/Mn) of 2-6 and a melting point (Tm) of 80°-120 ° C. When a copolymer does not have the above properties, the light-transmittance of toner is not achieved sufficiently, and fixing properties and heat resistance are deteriorated.

The polyester resins can be exemplified by the ones prepared by condensing polyols such as ethylenes glycol, triethylene glycol, 1,2-propylene glycol, 1,4-butanediol and the like with dicarboxylic acids such as maleic acid, itaconic acid, malonic acid and the like. A suitable polyester has a number average molecular weight of 2500-10000, a dispersion degree (Mw/Mn) of 2-6 and a melting point (Tm) of 80°-120° C. When a polyester does not have the above properties, the light-transmittance of toner is not achieved sufficiently, and fixing properties and heat resistance are deteriorated.

With respect to the colorants, C.I. pigment yellow 12 etc. available as a yellow colorant, C.I. pigment red 122 etc. available as a red colorant , C.I.pigment blue etc. available as a blue colorant etc. may be shown, but these are shown with no significance in restricting the embodiments of the invention. Other pigments and dyes contained in a conventional light-transmittable color toner may be used. The binder resin for a light-transmittable toner requires light transmittance, and so the binder resin has a relatively low viscosity. Therefore, toner particles are liable to aggregate. The combination of the carrier with the toner, however, does not bring about such a problem, because the pores on the surfaces of carrier particles works effectively to disintegrate the aggregations of toner particles.

The charge controlling agents are exemplified by the one represented by the following formula:

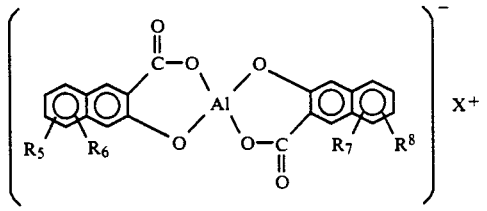

in which $R_5$-$R_8$ are respectively a $C_1$-$C_{10}$ alkyl group; $X^+$ is a hydrogen ion, an ammonium ion, an aliphatic ammonium ion or an aromatic ammonium ion.

With the use of such a charge controlling agent, a full color developer of the present invention can effect more effectively the prevention of toner scattering and fogs in the combination with the use of the above carrier.

A light-transmittable toner of the present invention may have any form, for example, a toner prepared by a grinding method in which the binder resin, the colorant and/or the charge controlling agent are mixed and kneaded, followed by being ground and classified, a spherical toner prepared by a suspension polymerization, an encapsulated toner in which a core is covered with a shell, and the like. The size of the toner is adjusted within the conventional range.

A toner of the present invention may be added with fluidization agents. Such a fluidization agents are exemplified by silica, aluminum oxide, titanium dioxide, a mixture of silica with aluminum oxide, a mixture of silica with titanium dioxide, a mixture of aluminum oxide with titanium dioxide and the like.

The preferable one is a mixture of silica with titanium dioxide, in which the ratio (silica/titanium oxide) is 0.1–0.3 (percents by weight) / 0.1–1 (percents by weight) to the toner and the mixture is added at 0.1–2 percents by weight to the toner. The fluidization agents may be subjected to a hydrophobic treatment with a coupling agent or a surfactant.

A developer for full color copy was prepared by mixing a light transmittable toner and a carrier, which are obtained as above mentioned. The developer for full color copy is excellent in electrification-buildup properties, prevention of toner scattering, disintegrating properties of toner aggregation and the like.

A toner is mixed with a carrier so as to occupy 6–12 percents by weight, preferably 7–10 percents by weight. If the mixing ratio is less than 6 percents by weight, the density of copied images becomes insufficient. If the ratio is more than 12 percents by weight, the toner particles scatter and pollute the inside of a copying machine, and the quality of copied images are lowered.

The toner content in the developer for full color is high as above mentioned. However, as there are pores and irregularities on the carrier surface, the contact between toner particles and carrier particles is secured to charge up the toner quickly to the adequate level. Therefore, the problems such as toner scattering, fogs and the like are not brought about.

A developer of the present invention can be applied to a multi-color printer or a multi-color PPC which can change the color at designated portions. The toner of the present invention can be also used to from light-transmittable copied images which can be projected by a projector such as an over head projector (OHP).

PRODUCTION EXAMPLE 1 OF CARRIER

(1) Preparation of Titanium-containing Catalyst Ingredient

N-heptane, which had been dehydrated at room temperature, of 200 ml and magnesium stearate, which had been dehydrated at 120° C. under vacuum (2 mmhg), of 15 g (25 mmol) were put in a flask having the capacity of 500 ml replaced with argon to be turned into a slurry. Titanium tetrachloride of 0.44 g (2.3 mmol) was added drop by drop to the resulting slurry with stirring and then the resulting mixture was heated and subjected to a reaction for one hour with refluxing. A viscous and transparent solution of a titanium-containing catalyst ingredient was obtained.

(2) Evaluation of the Activity of the Titanium-containing Catalyst Ingredient Dehydrated hexane of 400 ml, triethyl aluminum of 0.8 mmol, diethyl aluminum chloride of 0.8 mmol and the titanium-containing catalyst ingredient, which was obtained in the above described (1), of 0.004 mmol as titanium atoms were put in an autoclave having the capacity of 1 l replaced with argon and heated to 90° C. In this time, a pressure within a system amounted to 1.5 $kg/cm^2G$. Then, hydrogen was supplied to increase the pressure to 5.5 $kg/cm^2G$ and ethylene was continuously supplied so that the total pressure might be kept at 9.5 $kg/cm^2G$. The polymerization was carried out for one hour to obtain a polymer of 70 g. The polymerization activity was 365 kg/g.Ti-Hr and the MFR (the molten fluidity at 190 ° C. under load of 2.16 kg; JIS K 7210) of the obtained polymer was 40.

(3) Reaction of Titanium-containing Catalyst Ingredient with Fillers and Polymerization of Ethylene Hexane, which had been dehydrated at room temperature, of 500 ml and sintered ferrite-powders F-200 (having a mean particle diameter of 70 μm manufactured by Powder Tech K.K.), which had been dried for 3 hours at 200° C. under vacuum (2 mmhg), of 450 g were put in an autoclave having the capacity of 1 l replaced with argon and the stirring was started. Then, the temperature was increased to 40° C. and 0.02 mmol as titanium atoms of the titanium-containing polymerization catalyst ingredient obtained according to (1) above mentioned was added and the resulting mixture was subjected to a reaction about 1 hour. Subsequently, triethyl aluminum of 2.0 mmol and diethyl aluminum chloride of 2.0 mmol were added and the resulting mixture was heated to 90° C. In this time, a pressure within a system amounted to 1.5 $kg/cm^2G$. Then, hydrogen was supplied to increase the pressure until 2 $kg/cm^2G$ followed by conducting the polymerization for 40 minutes with continuously supplying ethylene so that the total pressure might be kept at 6 $kg/cm^2$ G to obtain a ferrite-containing polyethylene composition of 473 g in all. The composition was dried for 1 hour at the room temperature under vacuum (2 mmHg) to obtain dried powders. The dried powders exhibited a uniform grayish white color and it was found by the electron microscopic observation that a surface of ferrite was thinly coated with polyethylene and no aggregation of ferrite particles among themselves was observed.

In this step, the obtained composition was measured by means of TGA (thermal balance) with the result that ferrite was contained in a quantity of 95.2 percents by weight.

Then, the composition was put in a hot gas current adjusted at 120° C. to be subjected to heat treatment for 2.0 hours. The obtained composition was classified by means of a sieve having 106 μm sieve openings to remove particles of 106 μm or more.

PRODUCTION EXAMPLE 2 OF CARRIER

Ferrite of 450 g and the titanium-containing catalyst ingredient, which had been prepared in a manner similar to (1) of PRODUCTION EXAMPLE 1, of 0.02 mmol as titanium atoms were put in an autoclave having the capacity of 1 l replaced with argon and the resulting mixture was subjected to a reaction for one hour in the same manner as (3) of PRODUCTION EXAMPLE 1. Subsequently, carbon black (Ketchen black DJ-600; manufactured by Lion Akuzo K.K.) of 0.47 g was added to the reaction mixture through an upper nozzle of the autoclave. Carbon black, which had been dried for one hour at 200° C. under vacuum and turned into a slurry by the use of dehydrated hexane, was used. Subsequently, triethyl aluminum of 2.0 mmol and diethyl aluminum chloride of 2.0 mmol were added to the reaction mixture and the resulting mixture was heated to 90° C. In this time, a pressure within a system amounted to 1.5 kg/cm²G. Then hydrogen was supplied to increase the pressure until 2 kg/cm²G followed by conducting the polymerization for 45 minutes with continuously supplying ethylene so that the total pressure might be kept at 6 kg/cm²G to obtain a ferrite and carbon black-containing polyethylene composition of 469.3 g in all. The composition was dried for 1 hour at the room temperature under vacuum (2 MmHg) to obtain dried powders. The dried powders exhibited a uniform black color and it was observed by an electron microscope that a surface of ferrite was thinly coated with polyethylene and carbon black was uniformly dispersed in polyethylene. In addition, this composition was analyzed by TGA (thermal balance) with the results that ferrite was contained in a quantity of 95.9 percents by weight and a ratio by weight of ferrite, polyethylene and carbon black was 24:1:0.025 as calculated from charged quantities.

Then, the composition was put in a hot gas current adjusted at 120° C. to be subjected to heat treatment for 2.0 hours. The obtained composition was classified by means of a sieve having 106 μm or more to remove aggregated particles.

PRODUCTION EXAMPLE 3 OF CARRIER

Ferrite of 450 g and the titanium-containing catalyst ingredient, which had been prepared according to (1) of PRODUCTION EXAMPLE 1, of 0.01 mmol as titanium atoms were put in an autoclave having the capacity of 1 l replaced with argon and the resulting mixture was subjected to a reaction for 1 hour in the same manner as in PRODUCTION EXAMPLE 1. Then, carbon black (Ketchen black EC manufactured by Lion Akuzo K.K.) of 0.50 g was put in the autoclave through an upper nozzle of the autoclave. In addition, carbon black, which had been dried for 1 hour at 200° C. under vacuum and turned into a slurry by the use of dehydrated hexane, was used. Subsequently, triethyl aluminum of 1.0 mmol and diethyl aluminum chloride of 1.0 mmol were added to the resulting slurry and the resulting mixture was heated to 90° C. In this time, a pressure within a system amounted to 1.5 kg/cm²G. Then, 1-butene of 37.5 mmol (2.1 g) was introduced and hydrogen was supplied to increase the pressure until 2 kg/cm²G followed by conducting the polymerization for 28 minutes with continuously supplying ethylene so that the total pressure might be kept at 6 kg/cm²G to obtain a ferrite and carbon black-containing polyethylenic composition of 467 g in all. The composition was dried for 1 hour at the room temperature under vacuum (2 mmhg) to obtain dried powders. The dried powders exhibited a uniform black color and it was observed by means of an electron microscope that a surface of ferrite was thinly coated with the polymer and carbon black was uniformly dispersed in the polymer. In addition, this composition was measured by means of TGA (thermal balance) with the result that a ratio by weight of ferrite, polymer and carbon black was 27:1:0.03. Furthermore, the polymer, from which ferrite and carbon black had been removed, was obtained by the Soxhlet extraction (solvent:xylene) and subjected to the infrared absorption analysis with the confirmation that the obtained composition was a polyethylenic copolymer containing butene in a quantity of 8 percents by weight.

Then, the composition was put in a hot gas current adjusted at 120° C. to be subjected to heat treatment for 2.5 hours. The obtained composition was classified by means of a sieve having 106 μm sieve openings to remove the particles of 106 μm or more.

PRODUCTION EXAMPLE 4 OF CARRIER

Ferrite fine particles (having a volume mean particle size of 0.2 μm) of 200 parts by weight, polyester resin of bisphenol type (softening point: 123° C., glass transition point: 65° C., AV: 21, OHV: 43, Mn: 7600, Mw: 188400) of 30 parts by weight were mixed well in a Henschel mixer (10 l capacity) and kneaded well by a two-axial extrusion kneader. The obtained mixture was cooled, pulverized roughly and further pulverized into fine particles by a hammer mill, followed by being air-classified to remove rough particles and fine particles. Thus, child-particles having a volume mean particle size of 3.5 μm for forming coating layers were obtained.

Carrier core material (sintered ferrite particles F-200; made by Powder Tech K.K., volume mean particle size: 70 μm) of 100 parts by weight, the above child-particles of 20 parts by weight were mixed at 2000 rpm for 2 minutes in a Henschel mixer (10 l capacity) to adhere the child-particles to the carrier core particles uniformly. The obtained carrier core particles with the child-particles adhered to the surface thereof were provided into a hot gas current heated at 320° C. to be subjected to heat treatment for about 1–3 seconds for the formation of coating layers. A positive charge-controlling agent (Nigrosine Base EX: made by Oriento Kagaku Kogyo K.K.) of 2 parts by weight on the basis of 100 parts by weight of the resin-coated carrier particles were fixed on the coating layers in a similar manner. The obtained carrier particles were dipped in a 6 N Hcl aqueous solution for 2 hours, washed well with water and dried 60° C. for 5 hours in a vacuum. Thus, resin-coated carrier particles having pores on the surface thereof were obtained. The filling ratio of carrier core materials was 95.4 percents by weight.

PRODUCTION EXAMPLE 5 OF CARRIER

Ferrite fine particles having volume mean particle size of 0.2 μm (250 parts by weight) were added into a resin solution of thermosetting silicon resin (KR-255: made by Shinetsu Silicon K.K.) on the basis of 100 parts by weight of resin solids of the solution. The composition was stirred for uniform dispersion by ultrasonic means to prepare a coating solution. The coating solution was applied repeatedly to sintered ferrite powders (core materials) (F-200: 70 μm in mean particle size; made by Powder Tech K.K.) by SPIRA COTA (made by Okada Seiko K.K.) so that the resin layers of 25 percents by weight to the core materials might be formed on the core materials. Then, the system temperature was increased to 150° C. to cure the thermosetting resin. Thus, carrier particles coated with the thermosetting silicon resin having the ferrite particles dispersed therein were obtained. The obtained carrier was dipped in a 6N HCl solution for 2 hours, washed well with water and then dried in a vacuum for 5 hours at 60° C. Thus, resin-coated carrier particles having pores on the surface thereof were obtained. The filling ratio of carrier core materials was 91.5 percents by weight.

PRODUCTION EXAMPLE 6 OF CARRIER

A resin solution containing acrylic resin (Acrydick A 405; made by Dainippon Ink K.K.) at the solid content of 2 % was used as a coating solution.

The coating solution was applied repeatedly to sintered ferrite powders (core materials) (F-200: 70 μm in mean particle size; made by Powder Tech K.K.) by SPIRA COTA (made by Okada Seiko K.K.) so that the resin layers of 1.0 percent by weight to the core materials might be formed on the core materials. Then, the system temperature was increased to 150° C. to cure the resin. Thus, carrier particles coated with the thermosetting acrylic resin. The filling ratio of carrier core materials was 99.0 percents by weight.

The carriers obtained in Production Examples 1-6 had total pore volume (ml/g) referred to as one gram of carrier, total pore volume (ml/ml) referred to as one milliliter of resin of coating layer and mean pore size as shown in Table 1.

TABLE 1

| Carrier Production Example No. | total pore volume [ml/g] | total pore volume [ml/ml] | mean pore size [μm] |
|---|---|---|---|
| 1 | 0.043 | 0.878 | 0.301 |
| 2 | 0.042 | 1.025 | 0.281 |
| 3 | 0.038 | 1.061 | 0.248 |
| 4 | 0.022 | 0.801 | 0.305 |
| 5 | 0.031 | 0.534 | 0.300 |
| 6 | <0.0005 | — | — |

The total pore volume and the mean pore size were calculated from distribution of carrier pores. The distribution of carrier pores was measured by mercury porosimetry, using Pore Sizer 9310 (made by Shimazu Seisakusho K.K.) under conditions of 130° in mercury contact angle and 484 dyn/cm in surface tension. The results were shown in FIG. 4-FIG. 9.

Figure 4:
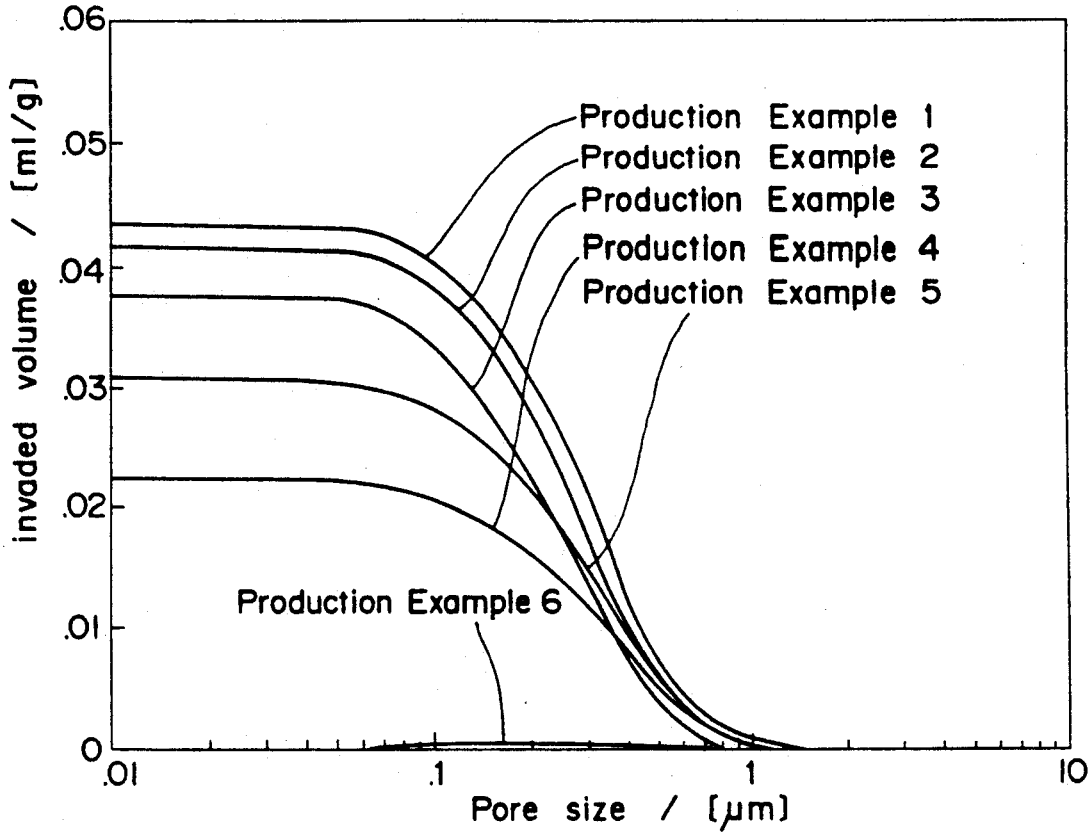
FIG. 4 shows a relationship between pore size and invaded volume.
Figure 5:
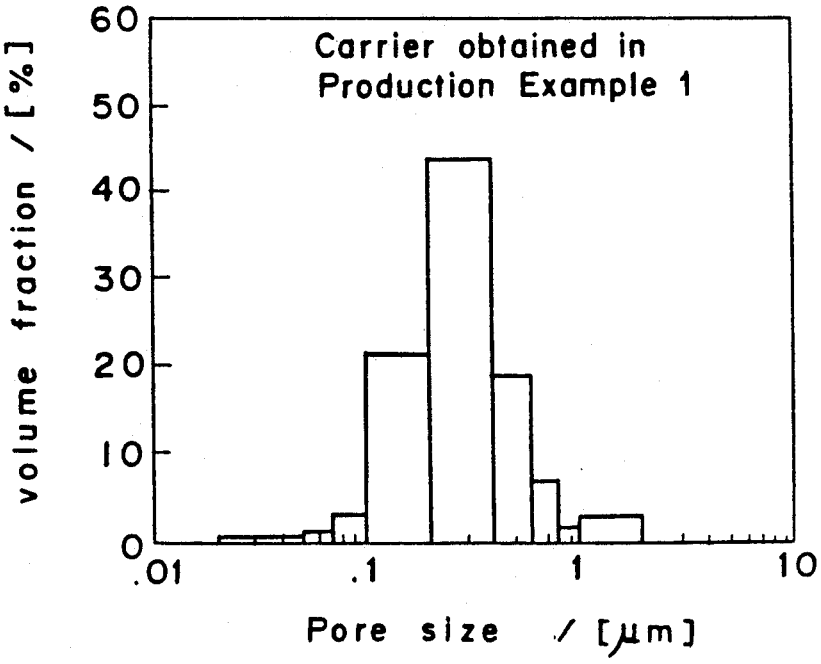
FIG. 5–FIG. 9 show a relationship between pore size and volume fraction.
Figure 6:
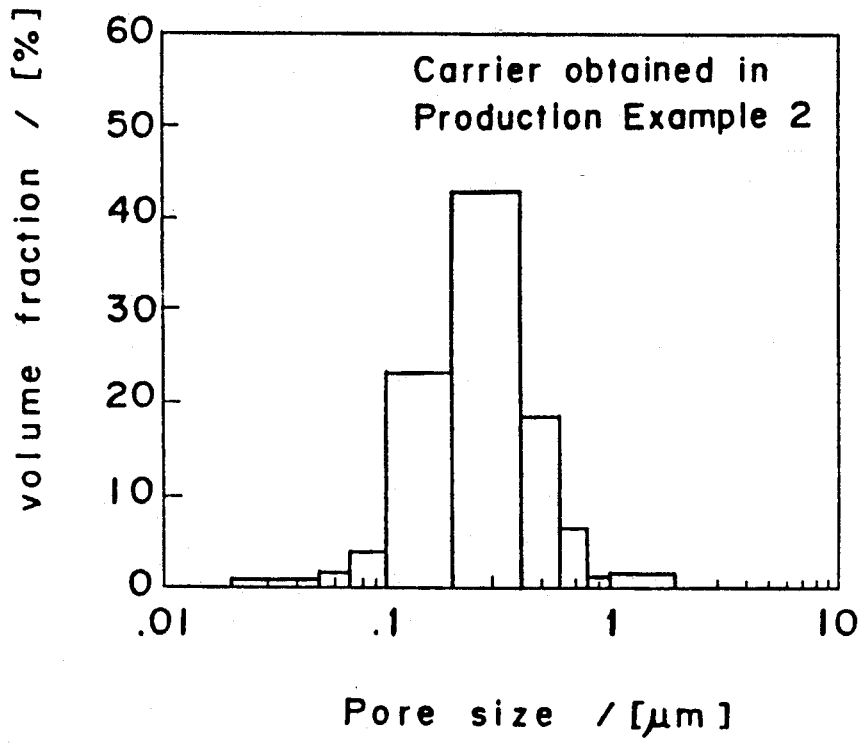
Figure 7:
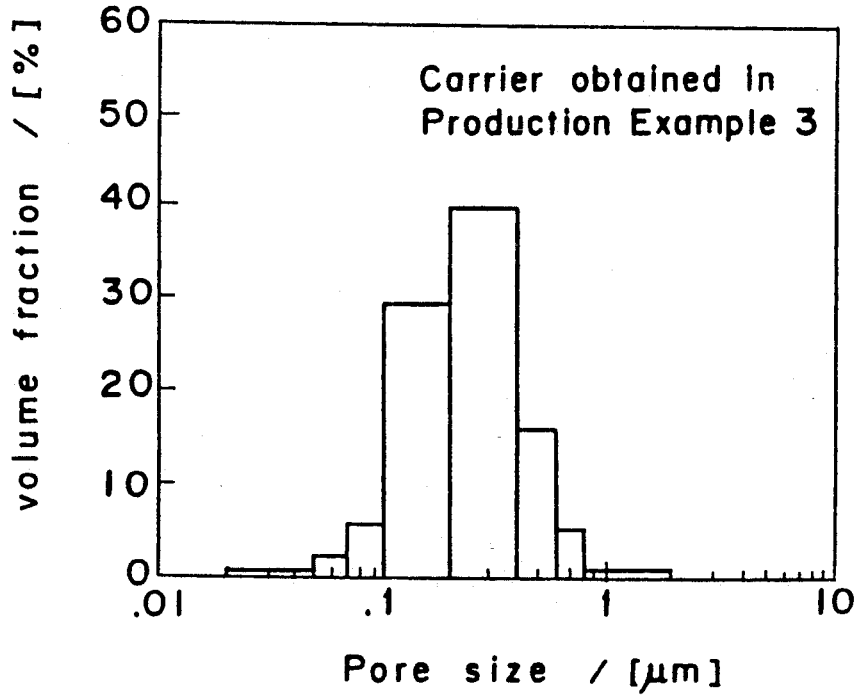
Figure 8:
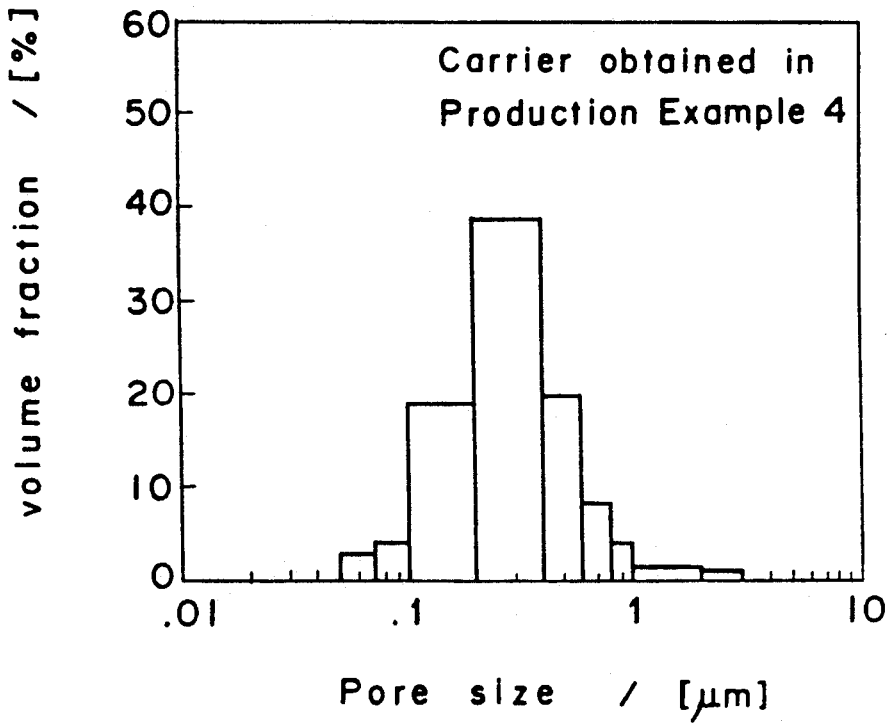
Figure 9:
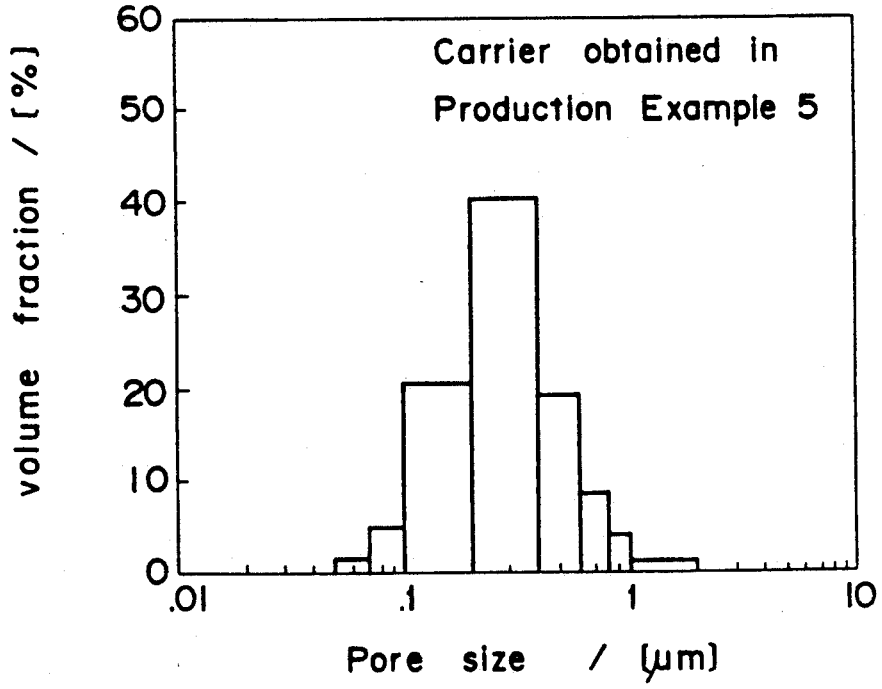

FIG. 4 shows the relationship between pore size and invaded volume. The invaded volume means the volume of mercury pressed into pores up to maximal pressure.

FIG. 5-FIG. 9 show the relationship between pore size and volume fraction. The volume fraction means the ratio (%) of the total volume of pores within the range of specified pore size to the total volume of all pores.

The carriers obtained in Production examples 1-6 had filling ratio of core materials (wt. %), true specific gravity (g/cm$^3$), bulk specific gravity (g/cm$^3$), electrical resistance (Ω·cm) and specific surface area (m$^2$/g) as shown in Table 2.

TABLE 2

| Carrier Production Example No. | filling ratio of core material [wt %] | true specific gravity [g/cm$^3$] | bulk specific gravity [g/cm$^3$] | electrical resistance [Ω · cm] | specific surface area [m$^2$/g] |
|---|---|---|---|---|---|
| 1 | 95.2 | 4.29 | 2.29 | $8.3 \times 10^{11}$ | 0.727 |
| 2 | 95.9 | 4.48 | 2.24 | $8.0 \times 10^{8}$ | 0.509 |
| 3 | 96.4 | 4.49 | 2.26 | $4.8 \times 10^{8}$ | 0.341 |
| 4 | 95.4* | 5.02 | 2.42 | $3.7 \times 10^{10}$ | 0.307 |
| 5 | 91.5* | 4.85 | 2.14 | $9.4 \times 10^{9}$ | 0.316 |
| 6 | 99.0 | 5.12 | 2.62 | $2.2 \times 10^{9}$ | 0.050 |

*after dipped in 6N HCl solution

The specific gravity was measured in the following procedures by the use of a measuring apparatus provided with an electronic balance:

the sensitivity is 0.1 mg;

a pycnometer:

a specific-gravity bottle having an inside capacity of 50 ml provided with a Gay-Lussac thermometer provided in JIS R 3501 (glass wares for use in the analytical chemistry); and a constant temperature bath:

a water temperature can be kept at 23±0.5

1) A weight of a pycnometer, which has been previously dried, is accurately measured until a figure of 0.1 mg.

2) The pycnometer is filled with n-heptane, which has been sufficiently degassed, and held in the constant temperature bath of 23°±0.5° C. followed by accurately setting a surface of a liquid to a gauge line. The pycnometer is taken out of the constant temperature bath and water stuck to an outside of the pycnometer is completely wiped off followed by accurately measuring a weight of the pycnometer with n-heptane therein until a figure of 0.1 mg.

3) Subsequently, the pycnometer is emptied and then filled with a sample of 10 to 15 g followed by accurately measuring a weight of the pycnometer with the sample therein again to subtract the result in 1) from the obtained result, whereby determining the weight of the sample.

4) Degassed n-heptane of 20 to 30 ml is gently put in the pycnometer with the sample therein to completely cover the sample with n-heptane followed by gently removing air from the liquid in a vacuum desiccator.

5) Then, the pycnometer is filled with degassed n-heptane until the vicinity of the gauge line and held in the constant temperature bath of 23°+0.5° C. for 1 hour. After the surface of the liquid was accurately set to the gauge line, the pycnometer is taken out of the constant temperature bath and water stuck to the outside of the pycnometer is completely wiped off followed by accurately measuring a weight of the pycnometer with the sample and n-heptane therein until a figure of 0.1 mg.

6) The specific gravity is calculated by the following equation:

$$S = a \cdot d / (b - c + a)$$

wherein

S: specific gravity;

a: weight of the sample (g);

b: weight (g) of the pycnometer with an immersion liquid filled until the gauge line thereof;

c: weight (g) of the pycnometer containing the sample with the immersion liquid filled until the gauge line thereof; and d: specific gravity of the immersion liquid at 23° C.

Bulk specific gravity was measured according to JIS Z 2504.

The electric resistance was calculated in inherent bulk resistance ρ by placing the sample having a thickness of 1 mm and a diameter of 50 mm on a metallic circular electrode, placing an electrode having a weight of 895.4 g and a diameter of 20 mm and a gird electrode having an inside diameter of 38 mm and an outside diameter of 42 mm on the sample, and reading a value of an electric current after 1 minute from a point of time when the application of a direct current voltage of 500 V was started. The measurements were repeated 5 times under the environment that a temperature was 25°±1° C. and a relative humidity was 55±5% and their mean value was adopted.

The specific surface area was measured by means of BET method on the basis of nitrogen gas absorption, using Flow Sorb 2300 (made by Shimazu Seisakusho K.K.).

PREPARATION OF CHARGE CONTROLLING AGENT

Synthesis Example

Sodium hydroxide (NAOH) of 15 g was added to water of one litter, followed by adding 2-hydroxy-3-naphthoic acid of 75 g to obtain an aqueous solution (referred to as "aqueous solution (1)". Aluminum sulfate of 34.3 g was dissolved in water of 0.4 liters to obtain an aqueous solution (referred to as "aqueous solution (2)"). the aqueous solution (2) was added gradually to the aqueous solution (1). The mixed solution was stirred for one hour at about 90°, and thin cooled to about 40° C. The solid materials were filtered, washed with water and dried to obtain the compound of 85 g represented by the following formula:

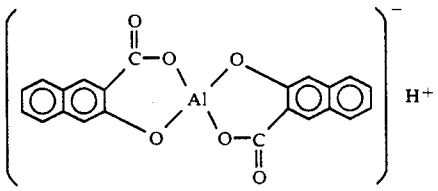

Preparation of Color Toner

Example 1

(i) Yellow Toner

Polyester resin (Mn=5000, Mw/Mn=2.3, Tg=65° C., AV=34, OHV=17, Tm=91° C.) of 100 parts by weight (which is abbreviate to "parts" hereinafter), the charge controlling agent obtained above of 1 part and Lionol Yellow FG-1310 (made by Toyo Ink Seizo K.K.) of 2.5 parts were mixed well in a Henschel mixer, kneaded in a two-axial extruder and then cooled. The kneaded mixture was pulverized coarsely, further pulverized into fine particles in a jet grinder, and then classified to obtain particles having particle size of 5–25 μm (mean particle size of 13.5 μm. Then, hydrophobic silica R 972 (made by Nippon Aerosil K.K.) of 0.1 part and titanium oxide T-805 (made by Nippon Aerosil K.K.) of 0.8 parts were mixed and then added to the above obtained particles. Thus, the obtained toner was referred to as yellow toner (1).

(ii) Magenta Toner

A magenta toner was prepared in a manner similar to that of yellow toner, except that Lionol Red 6B FG-4213 (made by Toyo Ink Seizo K.K.) of 2.5 parts and the charge controlling agent of 0.5 parts were used.

(iii) Cyan Toner

A cyan toner was prepared in a manner similar to that of yellow toner, except that Lionol Blue FG-7350 (made by Toyo Ink Seizo K.K.) of 2.5 parts and the charge controlling agent of 1.5 parts were used.

Evaluation of Developer (Toner Charging Speed and Toner Scattering Properties)

A developer was prepared using carriers and toners obtained above. The developer was evaluated on toner charging speed $\tau$ (sec) and toner scattering properties. The results were shown in Table 3.

The toner charging speed was measured according to the method described in Kenichi Karakida, Journal of Electrophotography (academic society of electrophotography) 402, 27 (1988), by the use of a developer containing toners (i)–(iii) at the content of 2 percents by weight.

The value shown in the Table 3 is a mean value of three values measured about three color developers which are prepared by mixing respective toners (i)–(iii) with, for example, the carrier (1) obtained in Production Example (1).

The toner scattering properties were measured as follows;

A developer was prepared in the combination of the toner and the carrier as shown in Table 3 so that the toner content (wt. %) might be obtained as shown in Table 3. The developer of 450 ml was put into a developing machine (EP-8600; made by Minolta Camera K.K.). Then, a motor was connected to a driving system of the developing machine and driven for 1 hour so that the circumferential speed of sleeve might be 60 cm/sec. Then, the scattering toner adhered to an opening portion of the sleeve in the developing machine was sucked. The sucked toner was weighed and ranked as follows;

◎:<10 mg
○:10–80 mg
Δ:30–80 mg
x:>80 mg

The value shown in Table 3 is a mean value of three values measured about each three color developers as above mentioned.

TABLE 3

| carrier production example | charging speed $\tau$ (sec) (toner mixing ratio (wt %)) | scattering properties (toner mixing ratio (wt %)) |
|---|---|---|
| 1 | 4.8 (2 wt %) | ◎ (8 wt %) |
| 2 | 5.7 (2 wt %) | ◎ (8 wt %) |
| 3 | 5.3 (2 wt %) | ◎ (8 wt %) |
| 4 | 7.4 (2 wt %) | ○ (8 wt %) |
| 5 | 6.2 (2 wt %) | ○ (8 wt %) |
| 6 (comparative example) | 17.4 (2 wt %) | Δ (8 wt %) |

DISINTEGRATING PROPERTIES

Carrier of 400 ml was put in a developing machine EP-8600 (made by Minolta Camera K.K.) and toner (iii) was put in a toner replenishing container installed in the developing machine so that the toner might be mixed at 8 percents by weight. Then, the developing machine was externally driven for 10 minutes at 60 cm/sec in circumferential sleeve speed. The dispersion conditions of toner particles in carrier particles were observed to be ranked as follows. The results were shown in Table 4.

○: toner aggregates were not observed and toner particles were mixed uniformly with carrier particles.
Δ: some toner aggregates were observed partially.
x: many toner aggregates were observed.

TABLE 4

| Production Example No. | Disintegrating Properties |
|---|---|
| 1 | ○ |
| 2 | ○ |
| 3 | ○ |
| 4 | ○ |
| 5 | ○ |
| 6 | Δ |

What is claimed is:

1. A developer for full color copy containing at least; light-transmittable toner particles comprising a polyester resin as a main component having a number average molecular weight (Mn):

$$2500 < Mn < 10000$$

a weight average molecular weight (Mw) and a dispersion degree:

$$2 < Mw/Mn < 6 \text{ and}$$

a melting point (Tm);

$$80° \text{ C.} < Tm < 120° \text{ C., and}$$

carrier particles with a number of pores having a mean pore size of 0.1–0.5μm on the surfaces thereof, the carrier particles comprising core materials having magnetism and resin materials coating the core materials and wherein the toner contains at least one fluidization agent selected from the group consisting of silica, aluminum oxide, titanium oxide, a mixture of silica with aluminum oxide, a mixture of silica with titanium oxide and a mixture of aluminum oxide with titanium oxide at a content of 0.1–2 percents by weight of the toner.

2. A developer of claim 1, in which the pore size is distributed within the range of 0.001–3 μm.

3. A developer of claim 2, in which the carrier particles are coated with the resin materials so that a coating ratio may be 70% or more.

4. A developer of claim 3, in which the core materials of the carrier particles have a mean particle size of 20–100 μm and are filled at a filling ratio of 90 percents by weight or more.

5. A developer of claim 4, in which the carrier particles have a specific gravity of 3.5–7.5.

6. A developer of claim 5, in which the carrier particles have an electrical resistance of about $1\times10^6$–about $1\times10^{14}$ Ω·cm.

7. A developer of claim 1, in which the carrier particles have surface irregularities having a shape factor S within the range of 130–200, the factor S being represented by the following formula;

$$S=\{(\text{outside circumference})^2/\text{area}\}\times\{1/(4\pi)\}\times100 \quad [I]$$

wherein the "outside circumference" is a mean value of outside circumferences of projected images of the carrier particles and the "area" is a mean value of projected areas of the carrier particles.

8. A developer of claim 1, in which the core materials are selected from the group consisting of ferrite, magnetite, iron, nickel, cobalt, an alloy thereof and a mixture thereof.

9. A developer of claim 8, in which the resin materials coating the core materials are olefinic resins, silicon resins, or poly(metha)acrylic resins.

10. A developer of claim 1, in which the carrier particles have a total pore volume of 0.1–2 ml/ml referred to as one milliliter of resin of coating layer.

11. A developer for full color toner containing at least; light-transmittable toner particles comprising a polyester resin as a main component having a number average molecular weight (Mn):

$$2500 < Mn < 10000$$

a weight average molecular weight (Mw) and a dispersion degree:

$$2 < Mw/Mn < 6 \text{ and}$$

a melting point (Tm);

$$80° \text{ C.} < Tm < 120° \text{ C., and}$$

carrier particles with a number of pores on the surfaces thereof having a pore size distributed within the range of 0.001–3μm, a mean pore size of 0.1–0.5 μm and a pore volume of 0.001–0.1 ml/g referred to as one gram of carrier particles, and the carrier particles comprising core materials having magnetism and resin materials coating the core materials and wherein the toner contains at least one fluidization agent selected from the group consisting of silica, aluminum oxide, titanium oxide, a mixture of silica with aluminum oxide, a mixture of silica with titanium oxide and a mixture of aluminum oxide with titanium oxide at a content of 0.1–2 percents by weight of the toner.

12. A developer of claim 11, in which the carrier particles are coated with the resin materials so that a coating ratio may be 70% or more.

13. A developer of claim 12, in which the core materials of the carrier particles have a mean particle size of 20–100 μm and filled at a filling ratio of 90 percents by weight or more.

14. A developer of claim 13, in which the carrier particles have a specific gravity of 3.5–7.5.

15. A developer of claim 14, in which the carrier particles have an electrical resistance of about $1\times10^6$–about $1\times10^{14}$ Ω·cm.

16. A developer of claim 11, in which the carrier particles have surface irregularities having a shape factor S within the range of 130–200, the factor S being represented by the following formula:

$$S=\{(\text{outside circumference})^2/\text{area}\}\times\{1/(4\pi)\}\times100 \quad [I]$$

wherein the "outside circumference" is a mean value of outside circumferences of projected images of the carrier particles and the "area" is a mean value of projected areas of the carrier particles.

17. A developer of claim 11, in which the core materials are selected from the group consisting of ferrite, magnetite, iron, nickel, cobalt, an alloy thereof and a mixture thereof.

18. A developer of claim 17, in which the resin materials coating the core materials are olefinic resins, silicon resins, or poly(metha)acrylic resins.

19. A developer of claim 18, in which fine particles having a charge controlling function or electrically conductive fine particles are contained at 0.1–60 percents by weight on the basis of the resin materials coating the core materials.

20. A developer of claim 11, in which the carrier particles are prepared by polymerizing a monomer on surfaces of core materials.

21. A developer for full color copy containing at least;

from 6 to 12 percent by weight light-transmittable toner particles comprising a polyester resin as a main component having a number average molecular weight (Mn):

$$2500 < Mn < 10000$$

a weight average molecular weight (Mw) and a dispersion degree:

$$2 < Mw/Mn < 6 \text{ and}$$

a melting point (Tm):

$$80° C. < Tm < 120° C.;$$

a charge controlling agent represented by the following formula:

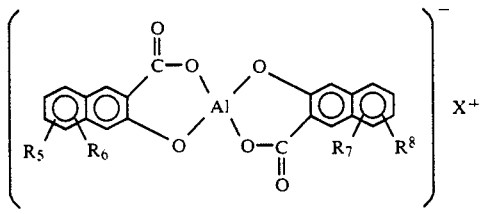

in which $R_5$–$R_6$ are respectively a $C_1$–$C_{10}$ alkyl group; $X^+$ is a hydrogen ion, an ammonium ion, an aliphatic ammonium ion or an aromatic ammonium ion; and carrier particles with a number of pores having a mean pore size of 0.1–0.5 μm on the surfaces thereof, the carrier particles comprising core materials having magnetism and resin materials coating the core materials and wherein the toner contains at least one fluidization agent selected from the group consisting of silica, aluminum oxide, titanium oxide, a mixture of silica with aluminum oxide, a mixture of silica with titanium oxide and a mixture of aluminum oxide with titanium oxide at a content of 0.1–2 percents by weight of the toner.

22. A developer for full color toner containing at least; from 6 to 12 percent by weight light-transmittable toner particles comprising a polyester resin as a main component have a number average molecular weight (Mn):

$$2500 < Mn < 10000$$

a weight average molecular weight (Mw) and a dispersion degree:

a melting point (Tm):

$$80° C. < Tm < 120° C.;$$

a charge controlling agent represented by the following formula:

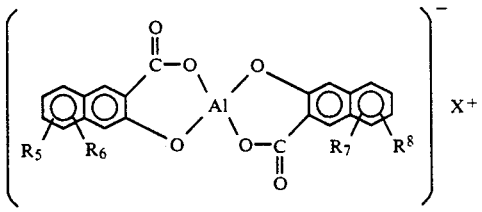

in which $R_5$–$R_8$ are respectively a $C_1$–$C_{10}$ alkyl group; $X^+$ is a hydrogen ion, an ammonium ion, an aliphatic ammonium ion or an aromatic ammonium ion; and carrier particles with a number of pores on the surfaces thereof having a pore size distributed within the range of 0.001–3 μm, a means pore size of 0.1–0.5 μm and a pore volume of 0.001–0.1 ml/g referred to as one gram of carrier particles; and the carrier particles comprising core materials having magnetism and resin materials coating the core materials and wherein the toner contains at least one fluidization agent selected from the group consisting of silica, aluminum oxide, titanium oxide, a mixture of silica with aluminum oxide, a mixture of silica with titanium oxide and a mixture of aluminum oxide with titanium oxide at a content of 0.1–2 percents by weight of the toner.

* * * * *